United States Patent [19]

Beck et al.

[11] 3,970,523

[45] July 20, 1976

[54] PROCESSES OF PRODUCING COKES OF LARGE LUMP SIZE AND IMPROVED STRENGTH FROM BITUMINOUS COALS

[75] Inventors: Kurt-Günther Beck; Wolfgang Rohde; Heinrich Echterhoff, all of Essen; Gerd Nashan, Oberhausen, all of Germany

[73] Assignee: Bergwerksverband GmbH, Essen, Germany

[22] Filed: Dec. 20, 1974

[21] Appl. No.: 534,897

Related U.S. Application Data

[63] Continuation of Ser. No. 350,466, April 12, 1973, abandoned.

[30] Foreign Application Priority Data

Nov. 24, 1972 Germany ..... 2257668

[52] U.S. Cl. ..... 201/1; 201/41; 201/44

[51] Int. Cl.[2] ..... C10B 57/02

[58] Field of Search ..... 201/1, 44, 41, 40; 202/150, 151, 139–144; 423/449, 460; 196/132

[56] References Cited

UNITED STATES PATENTS

| | | | |
|---|---|---|---|
| 1,907,568 | 5/1933 | Parr et al. | 201/44 |
| 2,658,862 | 11/1953 | Horner | 202/150 |
| 3,211,632 | 10/1965 | Otto | 202/142 X |

*Primary Examiner*—Hiram H. Bernstein
*Attorney, Agent, or Firm*—Michael J. Striker

[57] ABSTRACT

Improvements in the process of producing coke from bituminous coal in high-efficiency coking ovens, whereby the size of the lumps of coke and their strength are both increased, which comprises maintaining a coking rate between 1.2 and 2.8, and preferably between 1.44 and 2.0, inches per hour, based upon the width in inches of the coking chamber and the time required to complete the coking operation, and maintaining a rate of temperature increase between 1.6 and 3.3 centigrade degrees per minute during the heating of the coal while it is in the plastic range. The coal preferably is also preliminarily heated to a temperature between 160° and 250°C, preferably between 180° and 200°C, before being charged to the high-efficiency coking oven, and the width of the coking chamber of the high-efficiency oven that is used is at least 500 millimeters (19.7 inches).

10 Claims, No Drawings

PROCESSES OF PRODUCING COKES OF LARGE LUMP SIZE AND IMPROVED STRENGTH FROM BITUMINOUS COALS

BACKGROUND OF THE INVENTION

This application is a continuation of application Ser. No. 350,466 filed Apr. 12, 1973, and now abandoned.

All prior attempts to improve the productivity of horizontal by-product coking ovens by increasing the throughput of the coal in kilograms per cubic meter per hour depend upon reducing the coking period, by increasing the coking rate and increasing the rate of temperature increase during the heating of the coal while it is in the plastic range.

The mean coking rate, which is defined in terms of inches per hour herein, is based upon the width of the entire coking chamber in inches divided by the number of hours that are required to complete the coking of the coal. A mean coking rate based upon the width of the entire coking chamber in millimeters, is accordingly 25.4 times the said mean coking rate based upon the width of the coking chamber in inches.

The rate of temperature increase that occurs during the heating of the coal while it is in the plastic range, which is defined in terms of centigrade degrees per minute, is based upon the increase in temperature, as measured in the center of the coking oven chamber, in the range between 350° and 550°C, which is the plastic range and is the range in which the mass of coal that is being coked is in a semifused or plastic state. The shortened term "rate of temperature increase" will often be used hereinafter for convenience to refer to the rate of temperature increase that occurs during the heating of the coal while it is in the plastic range, particularly in the Tables hereinafter.

A reduction of the coking time and a corresponding increase in the output can be achieved by increasing the temperature of the heating flues, by reducing the thickness of the runner bricks of the flues, and by building the flues of bricks that have a high thermal conductivity. In this manner, both the coking rate and the rate of temperature increase during the heating in the plastic range are increased. In order to provide for increasing the temperatures of the heating flues to between 1200° and 1300°C, so-called high-efficiency ovens constructed of bricks having a high thermal conductivity, such as silica or calcined magnesite bricks, are required. In such ovens, the thickness of the runner bricks must also be reduced. The coking time in such ovens may be reduced, from between 20 and 24 hours that is normally required in conventional ovens, to less than 18 hours, often to 16 hours, and sometimes to approximately 8 hours. Since an increase in the productivity can be achieved by using such high-efficiency ovens, a corresponding reduction in costs in thereby also achieved.

Extensive coking tests have shown, however, that an increase in the rate of temperature increase during the heating in the plastic range produces a reduction in the strength and size of the lumps of the resulting cokes. The strength of the coke lumps is determined by an arbitrary rattler test which is described hereinafter. Coke consisting of lumps having such small sizes is quite desirable for some purposes, however; for example, such coke meets the requirements of the metallurgical industry for a blast-furnace coke having a maximum size of approximately 80 millimeters. However, a further increase in the rate of temperature increase during the heating in the plastic range produces coke lumps of smaller size that are no longer suitable for such use. The advantages of such high-efficiency ovens are accordingly nullified to a certain extent by the reduced quality of the coke that is thus produced. It is impossible to produce at least from certain coking coals a satisfactory coke for the metallurgical industry in such high-efficiency ovens. Coking rates in excess of 2.8 inches per hour sometimes lead to the production of cokes unsuitable for use in the metallurgical industry.

BRIEF SUMMARY OF THE INVENTION

The present invention is based upon the discovery that the rate of temperature increase during the heating of the coal while it is in the plastic range determines to a great extent the strength and the size of the lumps of coke that are produced in such coking processes in high-efficiency ovens. A rate of temperature increase in the plastic range of more than approximately 4° centigrade per minute is generally maintained in such high-efficiency ovens. As the rate of temperature increase during the heating in the plastic range increases beyond 4° centigrade per minute, the strength and size of the resulting coke lumps decrease. To obtain lumps of satisfactory strength and large size the rate of temperature increase during the heating in the plastic range must be decreased. To obtain large lumps of coke having adequate strength it is necessary to effect the coking at a coking rate between 1.2 and 2.8 inches per hour, preferably between 1.44 and 2.0 inches per hour, with a rate of temperature increase during the heating in the plastic range of 1.6° to 3.3°, and preferably between 2.2° and 2.8° centigrade per minute. To obtain these reduced coking rates and rates of temperature increase during the heating in the plastic range, other measures, such as are described hereinafter in the detailed description of this invention, are required.

DETAILED DESCRIPTION OF THE INVENTION

Although it is possible to control the coking rate and rate of temperature increase during the heating in the plastic range within the hereinbefore specified limits of 1.2 and 2.8 inches per hour and 1.6° to 3.3° centigrade per minute, by selection of coals having certain definite compositions, such efforts may also be nullified because of the unavailability of coking coals having the specified definite compositions. However, if the coal that is to be coked is preheated as described hereinafter, the specified coking rate and rate of temperature increase during heating in the plastic range are much more readily achieved in high-efficiency coking ovens.

In accordance with the process of the present invention, the bituminous coal that is to be coked is preliminarily heated to a temperature between approximately 160° and 250°C, and preferably between 180° and 200°C, prior to being charged into a high-efficiency coking oven of the type hereinbefore described. The heating to the specified temperature may be effected gradually or rapidly. This preliminary heating involves more than a simple preliminary drying of the coal, since the rate of temperature increase during the heating of such preheated coals while the coal is in the plastic range when they are coked in high-efficiency ovens remains about the same as it would be if the coking were effected in conventional coking ovens. This temperature increase during the heating in the plastic range is not as great as are the rates of temperature increase when wet coking coals or coking coals that were not subjected to such preheating are coked in high-efficiency ovens. It is possible to obtain large lumps of coke having adequate strength by use of high-efficiency ovens in accordance with the process of this invention, even when the coking is effected at a high coking rate.

The results obtained when the coking coal was preheated were quite unexpected, since it was expected that, as a result of the preheating, an increase of the coking rate would result, which would produce an increase in the rate of temperature increase during the heating while the coal was in the plastic state, even in conventional ovens, which would correspond to the results obtained in high-efficiency ovens with coking coal that was not subjected to preliminary heating. The preheating actually produced such a reduction in the rate of temperature increase during the heating when the coal is in the plastic state that the use of high-efficiency ovens need no longer be discouraged because of the danger of producing cokes the lumps of which were of a size that was too small if the process of the present invention is used. These results are in direct opposition to the prior teachings that, only by having a high rate of temperature increase during the heating while the coal is in the plastic range and a high coking rate, could a careful treatment of the bitumen and thereby a coke having increased strength be produced. Instead, exactly the same result that was expected to be obtained by maintaining a high rate of temperature increase during the heating while the coal is in the plastic range is now attained by maintaining a lower rate of temperature increase.

It was also discovered that a low rate of temperature increase during the heating while the coal is in the plastic range can be maintained by effecting the coking in chambers having a greater than normal width. The chambers of a conventional coking oven normally have a width of 450 millimeters (17.7 inches). In order to determine the effect of the width of the chambers on the coking rate, chambers having various widths from 300 to 600 millimeters were constructed and it was found that, to obtain the desired low rate of temperature increase during the heating while the coal is in the plastic range in high-efficiency ovens, the minimum width was 500 millimeters (19.7 inches).

In summation, it was quite unexpected that high-efficiency ovens which are especially adapted to coking coals at high temperatures and high coking rates while a high rate of temperature increase during the heating while the coal is in the plastic range is maintained, could be adapted for use in accordance with the process of the present invention to maintain a rate of temperature increase during the heating while the coal is in the plastic range between 1.6° and 3.3° centigrade per minute and, as a result, produce larger, stronger lumps of coke than could previously be produced in such ovens.

Even though improved results can be obtained without combining all three of the individual discoveries that are disclosed herein to obtain larger stronger lumps of coke, optimum results are obtained by the combination including the preheating of the coal to a temperature between 160° and 250°C, maintaining a coking rate between 1.2 and 2.8 inches per hour, and a rate of temperature increase between 1.6° and 3.3° centigrade during the heating while the coal is in the plastic range, and using a high-efficiency coke oven, the chambers of which have a width of at least 500 millimeters.

The tubulated results that follow which pertain to actual batches of coal that were coked under the specified conditions in the Tables, are included to illustrate and substantiate the effectiveness of the improved process that is described and claimed herein.

BATCHES 1–4

In the following Table are listed the results obtained in operating a conventional coke oven in which bituminous coal was coked at various temperatures. These results show that, as the temperature in centigrade degrees of the flues in the oven was increased, the coking rate in inches per hour and the rate of temperature increase during the heating while the coal was in the plastic range in centigrade degrees per minute both increased, and the quality of the resulting coal was reduced, both with respect to the size of the resulting lumps and in their strength as determined in the rattler test.

The lump sizes are defined and listed in the following Table as "percentage of lumps having sizes greater than 60 millimeters" which represents the percentage by weight of the lumps having a size greater than 60 millimeters that were present in the entire batch, that is, the percentage by weight of the batch of coke that was retained on a sieve the openings of which had a size of 60 millimeters.

The strength of the coke lumps which is listed in the Tables as "Result of rattler test, %" represents the percentage by weight of the lumps having a size greater than 40 millimeters that were retained on a sieve the openings of which had a size of 40 millimeters, after the lumps of coke had been subjected to the rattler test, which consists in placing a 50-kilogram sample of the coke in a drum and rotating the drum 100 times, and thereafter sieving the contents of the drum. The lumps which were retained on the sieve the openings of which had a size of 40 millimeters were then weighed and the percentage was computed from that weight.

| Batch No. | 1 | 2 | 3 | 4 |
|---|---|---|---|---|
| Heating flue temperature,°C | 1200 | 1300 | 1400 | 1500 |
| Coking rate, inch/hour | 0.98 | 1.13 | 1.18 | 1.22 |
| Rate of temperature increase, centigrade degrees/minute | 3.17 | 3.81 | 4.50 | 5.33 |
| Percentage of lumps having sizes greater than 60 millimeters | 87.4 | 82.1 | 78.9 | 65.2 |
| Result of Rattler test, % | 73.7 | 69.1 | 64.4 | 53.1 |

BATCHES 5–8

In the following Table are listed the results obtained in operating coke ovens the runner bricks of which were composed of different refractory compositions having different thermal conductivities. The oven that was used in connection with Batches 5 and 7 was built of bricks formed of a refractory composition containing silicon carbide having a thermal conductivity of 1.5 kilogram-calories per square meter per hour for a temperature gradient of 1° centigrade per meter at 1000°C, that is referred to in the Table as "SiC-contg.". The bricks of which the oven that was used in Batches 6 and 8 was constructed were formed of a refractory composition consisting essentially of calcined magnesite having a thermal conductivity of 3.0 kilogram-calories per square meter per hour for a temperature gradient in centigrade degrees per meter at 1000°C, which is referred to in the Table as "MgO-contg.".

| Batch No. | 5 | 6 | 7 | 8 |
|---|---|---|---|---|
| Refractory composition | SiC-contg. | MgO-contg. | SiC-contg. | MgO-contg. |
| Heating flue temperature, °C | 1000 | 1000 | 1200 | 1200 |
| Coking rate, inch/hour | 0.75 | 1.13 | 1.00 | 1.48 |
| Rate of temperature increase, centigrade degrees/minute | 1.66 | 2.85 | 3.00 | 6.66 |
| Percentage of lumps having sizes greater than 60 millimeters | 95.9 | 89.0 | 90.3 | 65.6 |
| Result of rattler test, % | 86.4 | 81.4 | 81.5 | 65.4 |

It is to be noted that, when using ovens built of bricks having a higher thermal conductivity than the bricks of which the ovens that were used in connection with Batches 1–4 were built, as the flue temperature is increased during the heating while the coal is in the plastic range and the coking rate is increased, the quality of the coke is reduced as was also observed in connection with the preceding Batches 1–4.

BATCHES 9–14

In the following Table are listed the results obtained in operating a conventional coke oven in the coking of bituminous coal at various flue temperatures but at a lower rate of temperature increase during the heating of the coal while in plastic range than was used in Batches 1–4 hereinbefore. In these batches, the different results obtained in coking coal in its original wet state as mined and after being preheated to a temperature of 200°C, before being subjected to coking, as described hereinbefore, are also listed.

| Batch No. Coal | 9 wet | 10 preheated | 11 wet | 12 preheated | 13 wet | 14 preheated |
|---|---|---|---|---|---|---|
| Heating flue temperature, °C | 1200 | 1200 | 1300 | 1300 | 1400 | 1400 |
| Coking rate, inch/hr. | 0.98 | 1.13 | 1.09 | 1.34 | 1.19 | 1.51 |
| Rate of temperature increase, centigrade degrees/minute | 3.17 | 1.02 | 3.81 | 3.78 | 4.50 | 3.22 |
| Percentage of lumps having sizes greater than 60 millimeters | 87.4 | 87.9 | 82.1 | 85.0 | 78.2 | 78.7 |
| Result of rattler test,% | 73.7 | 73.7 74.1 | 69.1 | 70.9 | 64.4 | 64.5 |

BATCHES 15–19

In the following Table are listed the results obtained in the coking of bituminous coal at the same flue temperature in high-efficiency horizontal ovens having different chamber widths.

| Batch No. | Chamber width, millimeters | Rate of temperature increase, centigrade degrees/minute | Coking rate, inch/hour | Percentage of lumps having sizes greater than 60 millimeters | Result of rattler test,% |
|---|---|---|---|---|---|
| 15 | 300 | 5.8 | 1.28 | 29 | 58 |
| 16 | 400 | 4.8 | 1.26 | 37 | 65 |
| 17 | 450 | 4.2 | 1.24 | 41 | 70 |
| 18 | 500 | 3.5 | 1.23 | 45 | 73 |
| 19 | 600 | 2.4 | 1.22 | 53 | 81 |

BATCHES 20–22

In the following Table are listed the results obtained in the coking of bituminous coal that had preliminarily been preheated to different temperatures before being subjected to coking.

| Batch No. | 20 | 21 | 22 |
|---|---|---|---|
| Preheating temperature, °C | 170 | 220 | 265 |
| Coking rate, inch/hour | 1.04 | 1.11 | 1.22 |
| Rate of temperature increase, centigrade degrees/minute | 2.52 | 2.30 | 2.36 |
| Percentage of lumps having sizes greater than 60 millimeters | 81.8 | 82.2 | 81.7 |
| Result of rattler test,% | 69.0 | 69.0 | 68.0 |

Inasmuch as the foregoing description comprises preferred embodiments of the invention which were selected solely for purposes of illustration, it is to be understood that the invention is not restricted thereto, and that variations and modifications may be made therein in accordance with the teachings hereinbefore, without departing from the invention, whose scope is to be limited solely by the appended claims.

We claim:

1. A process for the production of coke from coal, particularly from bituminous coal, comprising the steps of preliminarily heating coal having a plastic temperature range of about 350° to 550°C to a temperature in the range of approximately 160° to 250°C; and coking the preliminarily heated coal in a substantially horizonatally oriented chamber of an oven by additionally heating the preliminarily heated coal, the coking being effected at a mean coking rate between about 1.2 and 2.8 inches per hour, and the additional heating comprising maintaining the rate of temperature increase as measured in the region of the center of the chamber between about 1.6° and 3.3° centigrade per minute in the plastic temperature range of the coal.

2. A process as defined in claim 1 in which the coking is effected at a mean coking rate between about 1.44 and 2.0 inches per hour.

3. A process as defined in claim 1 in which the coal is preliminarily heated to a temperature between about 180° and 200°C before being charged into the coking oven.

4. A process as defined in claim 1 in which the coking is effected in a coking chamber having a width of at least 500 millimeters.

5. A process as defined in claim 1 in which the coking is effected in a coking oven, the runner bricks of which are formed of a refractory composition containing silicon carbide.

6. A process as defined in claim 1 in which the coking is effected in a coking oven, the runner bricks of which are formed of a calcined magnesite refractory composition.

7. A process as defined in claim 1 in which the rate of temperature increase is between about 2.2° and 2.8° centigrade per minute.

8. A process as defined in claim 1 in which the preliminary heating of the coal comprises drying the coal.

9. A process as defined in claim 1 in which the rate of temperature increase is at least 2.2° centigrade per minute.

10. A process as defined in claim 8 in which the coking rate is between about 1.44 and 2.0 inches per hour and the rate of temperature increase is between about 2.8° and 3.3° centigrade per minute.

* * * * *